US005464254A

United States Patent [19]

Campbell et al.

[11] Patent Number: 5,464,254

[45] Date of Patent: Nov. 7, 1995

[54] FISHING LICENSE PROTECTOR

[75] Inventors: Joe E. Campbell, Portland; Del Isaac, Salem, both of Oreg.

[73] Assignee: Moore Business Forms, Inc., Grand Island, N.Y.

[21] Appl. No.: 297,221

[22] Filed: Aug. 29, 1994

[51] Int. Cl.[6] ..... B42D 15/00

[52] U.S. Cl. ..... 283/109; 283/108; 283/107; 283/75; 283/115

[58] Field of Search ..... 283/74, 75, 81, 283/107, 108, 109, 110, 111, 49, 115, 117

[56] References Cited

U.S. PATENT DOCUMENTS

| | | | |
|---|---|---|---|
| 2,671,678 | 3/1954 | Walsh . | |
| 2,898,257 | 8/1959 | Carver . | |
| 3,204,354 | 9/1965 | Berger | 283/108 |
| 3,312,005 | 4/1967 | McElroy . | |
| 3,505,140 | 4/1970 | Dunn . | |
| 3,854,229 | 12/1974 | Morgan . | |
| 3,918,188 | 11/1975 | Drower et al. . | |
| 4,151,666 | 5/1979 | Raphael et al. . | |
| 4,159,586 | 7/1979 | Blum . | |
| 4,184,701 | 1/1980 | Franklin et al. . | |
| 4,248,919 | 2/1981 | Davis . | |
| 4,278,722 | 7/1981 | Hoppe et al. | 283/108 X |
| 4,343,851 | 8/1982 | Sheptak . | |
| 4,429,015 | 1/1984 | Sheptak . | |
| 4,768,811 | 9/1988 | Oshikoshi et al. . | |
| 4,826,213 | 5/1989 | Matsuguchi et al. . | |
| 5,060,981 | 10/1991 | Fossum et al. | 283/75 X |
| 5,100,181 | 3/1992 | Nathans . | |
| 5,131,686 | 7/1992 | Carlson . | |
| 5,153,042 | 10/1992 | Indrelie . | |
| 5,203,962 | 4/1993 | Renquist . | |
| 5,283,093 | 2/1994 | All . | |
| 5,284,363 | 2/1994 | Gartner et al. . | |
| 5,351,993 | 10/1994 | Wright et al. . | |

*Primary Examiner*—Willmon Fridie, Jr.
*Attorney, Agent, or Firm*—Nixon & Vanderhye

[57] ABSTRACT

A business form that is particularly suitable for use as a fishing and/or hunting license is easy to understand and use, is protected from moisture, chemicals and wear, allows for the entry of indicia that will be readable after use for a year, cannot readily be accurately photocopied, will not fade as a result of exposure to sunlight, and has a tamper-evident feature. A first quadrate ply of opaque cellulose based water resistant material is permanently attached at only a first portion to a second quadrate ply of transparent plastic material. A second adhesive pattern, applied to both cooperating faces of the first and second plies, or merely to one of the faces, releasably connects the plies together, but is adapted to receive a separable sheet, typically a hunting and/or fishing license, between the plies and to hold the fishing license in place. First indicia facilitating entry of fish caught or game shot data is imaged on the opposite face of the first ply from the second ply. Security indicia, in the form of an opaque white ink providing a pseudo mark, may be applied to the second ply to make accurate production by a photocopier difficult. The second ply is preferably polyester or polyethylene film having a UV coating. The first ply preferably comprises a cellulose sheet coated with wet strength additives which confer water dispersion resistance to the cellulose sheet. The second adhesive pattern may comprise interspersed adhesive strips on both the first and second plies, with the security indicia imaged over the adhesive on the second ply.

20 Claims, 2 Drawing Sheets

FIG. 3
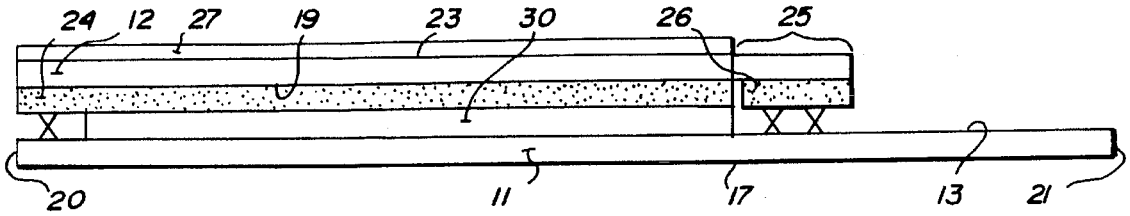
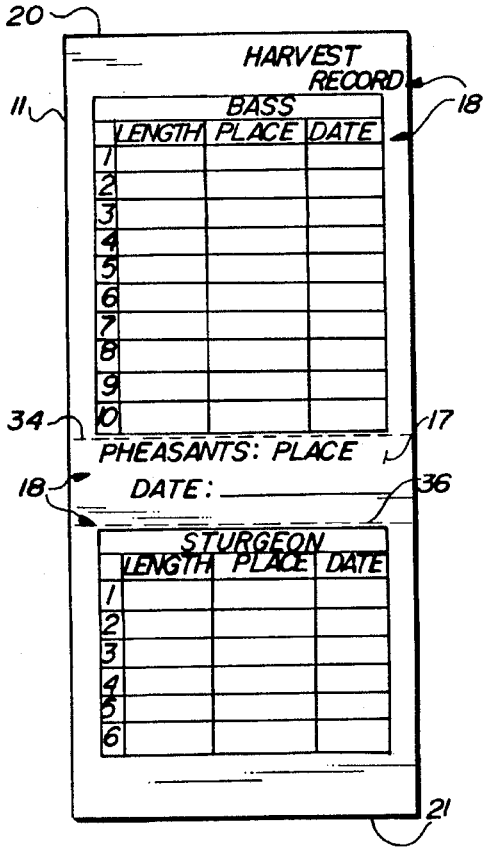
FIG. 4
FIG. 5
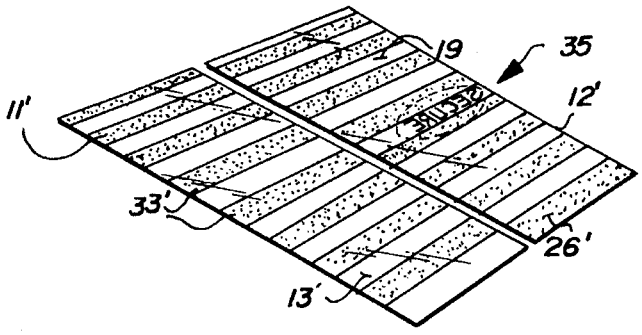

FISHING LICENSE PROTECTOR

BACKGROUND AND SUMMARY OF THE INVENTION

Organizations that issues licenses often need to collect data from the license users, and the data must be maintained in a readily recoverable form for a significant period of time. For example states which sell fishing and hunting licenses typically need to recover a "catch" or "bag" record from each of the license holders. The licenses must be resistant to the elements, however, because they must be carried by the fisherman or hunter in inclement weather or into adverse environmental conditions. Conventional paper fishing and hunting licenses have not proven to be suitable for a number of reasons.

Conventional paper hunting and fishing licenses often are not protected from moisture, chemicals or wear. If they are protected, such as by plastic coating, then it is not possible to permanently enter catch or bag data on them, therefore this information must be entered on separate documents. Also conventional fishing and hunting licenses are relatively easy to reproduce on photocopiers, and can fade if exposed to sunlight. In general it is difficult for conventional licenses to provide readily readable catch or bag record information for extended periods of time (typically a year for most licenses).

According to the present invention a business form is provided which is ideally suited for licenses, particularly fishing and hunting licenses, and which overcomes the problems with conventional licenses. The business form according to the present invention is easy to understand and use, and protects the license permanently from moisture, chemicals and wear. A security feature is provided, such as in the form of a pseudo water mark which will typically "drop out" if photocopied. A UV coating is provided on a transparent plastic sheet which covers the license so that it will be resistant to fading. Also a tamper-evident feature may be provided to prevent unauthorized tampering with the license. Catch or bag data may be easily recorded on the license document and will remain readable for extended periods of time, e.g. for a year until the appropriate government agency collects the data.

According to one aspect of the present invention a business form is provided comprising the following elements: A substantially quadrate first ply of an opaque cellulose based water resistant material having first and second faces, first length and width dimensions, and a first area of said first and second faces. A substantially quadrate second ply of transparent plastic material having third and fourth faces, second length and width dimensions, and a second area of the third and fourth faces. A first pattern of permanent adhesive substantially permanently attaching only a first portion of the second ply third face to the first ply first face. A second pressure sensitive adhesive pattern for connecting a second portion of the second ply third face, distinct from the first portion, to the first ply first face, or for substantially permanently adhering a separate sheet therebetween. And, first indicia facilitating entry of recoverable data imaged on the first ply second face.

Typically the business form further comprises a separable sheet, distinct from the first and second plies, having second indicia thereon, the second indicia typically being fishing and/or hunting license indicia. The separable sheet has a third area less than either the first or second areas, and length and width dimensions such that it may be disposed between the second portion of the second ply third face and the first ply first face to be held therebetween by the second adhesive pattern with the second indicia visible through the second ply. The second adhesive pattern may be aggressive enough to provide a tamper-evident feature by tearing the separable sheet if separated from it. Normally the second area is less than the first area, defining an always uncovered portion of the first ply first face, and third indicia is imaged on that uncovered portion.

The second adhesive pattern may be disposed on the second portion of the second ply third face. The second adhesive pattern may comprise a plurality of parallel spaced strips of adhesive, and those may be interspersed with spaced parallel strips of adhesive on the first face.

Security indicia may be applied to the second ply. The security indicia makes accurate reproduction of the form by a photocopier difficult (including impossible). The security indicia may be an opaque white ink providing a pseudo water mark. The security indicia may be applied on the fourth face or the third face, and if applied on the third face either under or over the second adhesive pattern. If it is applied over the second adhesive pattern then if the plies are separated a tamper-evident feature will be provided because remating of the security feature portions will be difficult.

The second ply is typically polyester, Mylar, or polyethylene film, which has a UV coating to minimize fading of the license. The first indicia preferably comprises indicia facilitating entry of fish caught or game shot or both, and may include data about the particular catch or bag including place, size, species, etc. The first ply preferably comprises a cellulose sheet coated with wet strength additives which confer water dispersion resistance, such as epichlorhydrin type cross-linking agents, or polyfunctional amines and imines.

According to another aspect of the present invention a business form is provided comprising the following elements: A substantially quadrate first ply of an opaque cellulose based water resistant material having first and second faces, first length and width dimensions, and a first area of the first and second faces. A substantially quadrate second ply of transparent plastic material having third and fourth faces, second length and width dimensions, and a second area of the third and fourth faces. A first pattern of permanent adhesive substantially permanently attaching only a first portion of the second ply third face to the first ply first face. A second pressure sensitive adhesive pattern for connecting a second portion of the second ply third face, distinct from the first portion, to the first ply first face, or for substantially permanently adhering a separate sheet therebetween. And, wherein the second ply is polyester or polyethylene film having a UV coating.

According to yet another aspect of the present invention a business form is provided comprising: A substantially quadrate first ply of an opaque cellulose based water resistant material having first and second faces, first length and width dimensions, and a first area of the first and second faces. A substantially quadrate second ply of transparent plastic material having third and fourth faces, second length and width dimensions, and a second area of the third and fourth faces. A first pattern of permanent adhesive substantially permanently attaching only a first portion of the second ply third face to the first ply first face. A second pressure sensitive adhesive pattern for connecting a second portion of the second ply third face, distinct from the first portion, to the first ply first face, or for substantially permanently adhering a separate sheet therebetween. And, further comprising security indicia applied to the second ply, the security indicia making accurate reproduction of the form by a photocopier difficult.

It is the primary object of the present invention to provide a business form that is ideally suited for use with licenses where data must be recorded, and particularly for use with and comprising hunting and fishing licenses. This and other objects of the invention will become clear from an inspection of the detailed description of the invention, and from the appended claims.

BRIEF DESCRIPTION OF THE DRAWINGS

FIG. 3 is a side view of the business form of FIG. 2 with the thickness of the components greatly exaggerated for clarity of illustration;

FIG. 4 is a bottom plan view of the business form of FIGS. 1 and 2; and FIG. 5 is a top exploded view of an alternative exemplary embodiment of the business form according to the invention.

DETAILED DESCRIPTION OF THE DRAWINGS

Figure 1:
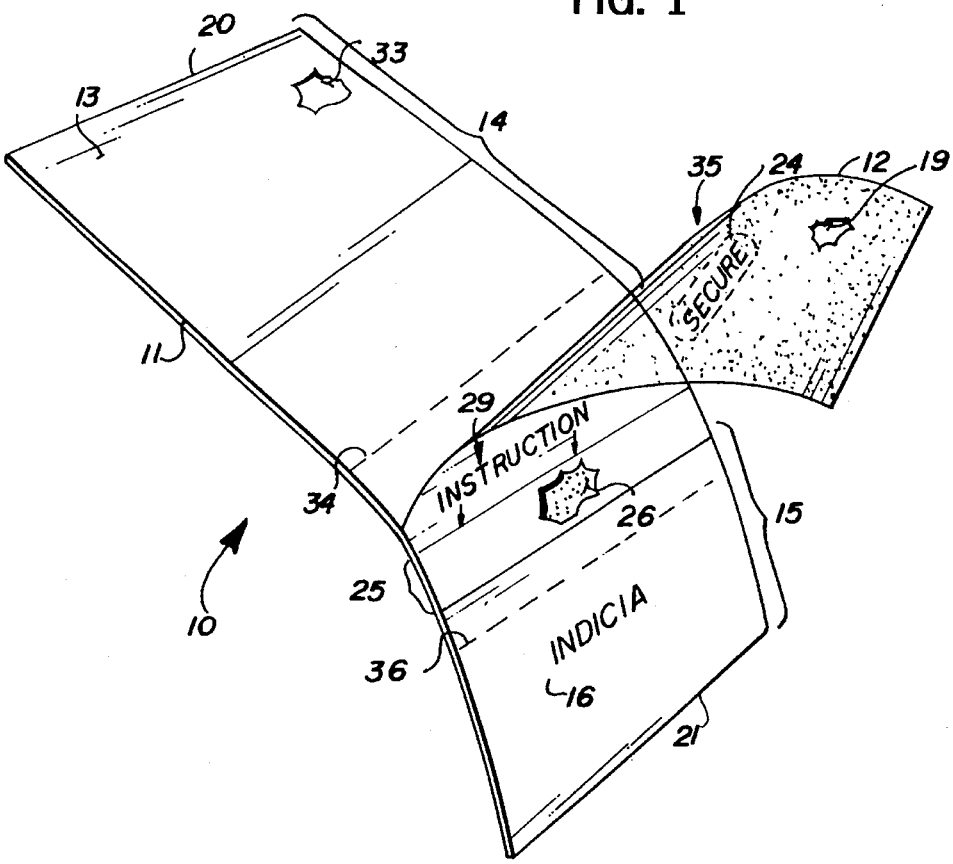
FIG. 1 is a top perspective view of an exemplary business form according to the present invention showing the first and second plies thereof separated from each other.

An exemplary business form according to the present invention is shown generally by reference numeral 10 in FIG. 1. It comprises a substantially quadrate first ply 11 of an opaque cellulose based water resistant material. The form 10 also comprises a substantially quadrate second ply 12 of transparent plastic material.

The first ply 11 has a first face 13 and a length which is the sum of the portions 14, 15 and 25, and a predetermined width. It also has a first area, both the first face 12 and the second face 17 (see FIGS. 3 and 4) having the same area. The material of which the first ply 11 is made may be, for example, a Permafiber substrate from Permafiber Corporation of New York, N.Y., such as Permafiber board, Permafiber tag stock, or Permafiber paper (the latter being preferred). These products comprise cellulose bases which are coated with wet strength additives such as epichlorhydrin type cross-linking agents, or polyfunctional amines and imines, which confer water dispersion resistance to the paper stock.

Figure 2:
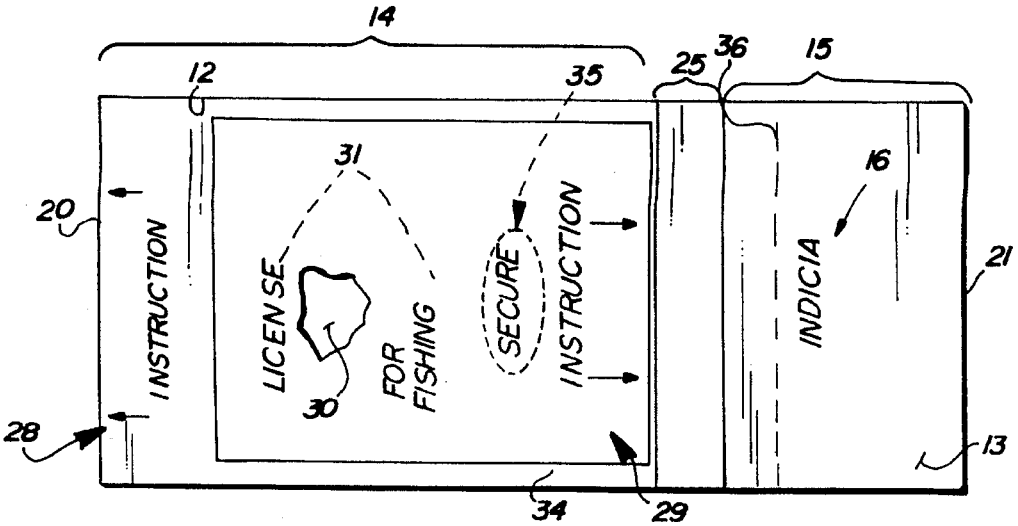
FIG. 2 is a top plan view of the form of FIG. 1 with the plies in engagement with each other, and with a fishing license disposed therebetween and forming part of the form.

As easily seen in each of FIGS. 1 through 3, the first ply 11 has a greater area than the second ply 12. Preferably they have the same width, but the first ply 11 extends past the end of the second ply 12 the length of portion 15 seen in FIGS. 1 and 2. The portion 15 is thus an uncovered portion of the first ply, and third indicia 16 (see FIGS. 1 and 2) is imaged on the face 13 thereof.

On the second face 17 of the first ply 11 various first indicia 18 are provided (see FIG. 4). The indicia 18 facilitate entry of recoverable data such as entry of fish caught, game shot, or both. For example there may be entry locations for the length, place, and date several species of fish are caught, the place, date, and weight, pheasants or other game birds or animals are bagged, etc. The first ply 11 also has first and second parallel end edges 20, 21.

The business form 10 further comprises first and second patterns 26, 24, respectively of adhesive. The first pattern 26, seen most clearly in FIG. 3, is permanent (e.g. pressure sensitive) adhesive that substantially permanently attaches the first portion 25 of the second ply 12 to the first face 13 of the first ply 11. [Since FIG. 3 is a schematic illustration the adhesive 26 is shown connected to the face 13 by the "Xs", but when the components have the thinness that they have in reality, adhesive 26 directly engages the face 13 and anything disposed between the plies 11, 12 will just provide a minor bulge.]

The second adhesive pattern 24 preferably releasably connects a second portion of the ply 12—preferably essentially all of the ply 12 except for the portion 25—to the first ply 11 first face 13, but can permanently hold another ply therebetween. In the embodiment illustrated in FIGS. 1 and 3, the adhesive pattern 24 is applied to the inner face 19 of the second ply 12, while the outer face 23 of the second ply 12 is free of adhesive.

The second ply 12 preferably comprises a clear plastic film, such as a polyester, Mylar, or polyethylene film. The film 12 preferably is provided with a UV coating as shown schematically at 27 in FIG. 3, applied over the outer face 23. Any suitable conventional UV coating may be utilized such as that obtained from Radcure Corporation of Livingston, N.J., and it may be applied as conventionally, for example using a flexo unit. The UV coating 27 imparts properties to the film 12 such that any underlying paper sheet will not easily fade even when exposed to sunlight.

When the business form 10 is in the initial configuration so thereof illustrated in FIG. 1, there is nothing between the faces 13, 19 except—if desired—a piece of release paper to allow ready release from the adhesive 24 and prevent the faces 13, 19 from sticking together until another document—such as a fishing license—has been inserted therebetween.

The second ply 12 also preferably comprises instruction indicia 28, 29 (see FIG. 2) thereon which tells the user of the business form 10 how to use it. For example the instruction indicia 29— which is typically imaged on the top face 23 of the ply 12—instructs the user to place the bottom of a fishing license tag adjacent the top of the permanent adhesive pattern 26 and then to press down the ply 12 to cover the tag and seal. The indicia 28 may, for example, instruct the user to lift the ply 12 up initially in order to insert the fishing license.

FIGS. 2 and 3 illustrate the business form 10 according to the invention with a fishing license 30, in the form of a separable sheet distinct from the plies 11, 12, inserted therebetween covering a part of the portion 14. The separable sheet 30 has indicia 31 thereon which is visible through the ply 12 when the components are assembled together (as illustrated in FIGS. 2 and 3), the indicia 31 preferably comprising indicia indicating the issuance of a license by the state or another organization, such as a hunting or fishing license. In the embodiment illustrated in FIGS. 2 and 3, the adhesive 24 is pressure sensitive adhesive which overlaps the license 30 and adheres to it and to the surrounding part of the portion 14 of the first ply 11. The adhesive 24 may be any suitable conventional pressure sensitive adhesive, but preferably is a permanent adhesive having sufficient aggressiveness so that once the portions of the business form 10 are in the position illustrated in FIGS. 2 and 3 and the ply 12 is firmly pressed down to seal the adhesive 24 with so the license 30 and the face 13 overlapping the license 30, if the plies 11, 12 are separated the fibers of the license 30 will tear, blurring the indicia 31 and providing a tamper-evident feature.

The adhesive system utilized according to the invention may comprise a wide variety of other types. For example adhesive can also be applied to the face 13 portion 14, as illustrated schematically for only a portion of the face 13 at 33 in FIG. 1. In a preferred embodiment— as illustrated in FIG. 1—adhesive is applied to both faces 19, 13, but in a manner such that the plies 11, 12 will readily separate from each other but will not readily separate once the license 30 is inserted therebetween. In the embodiment illustrated in FIG. 5, adhesive patterns 24' provided on the face 19' of the first ply 12' are strips or bands of adhesive which are interspersed with strips or bands 33' provided on the face 13' of the first ply 11'.

The adhesive 24', 33' may be of the type that will be removable from the material of the plies 11', 12', both of which have at least relatively smooth shiny surfaces. However the adhesive 24', 33' has sufficient aggressiveness that when it engages a conventional piece of paper, which the license 30 is typically made of, it will not be readily removable. Alternatively, the bands between the strips 24', 33' of each of the plies 11', 12' may be coated with release material, which is known per se (see U.S. Pat. No. 3,312,005). The first pattern of permanent adhesive 26' will permanently adhere to the face 13'.

If desired the ply 11 may also have various lines of weakness therein to facilitate separation of the different parts of the data recorded with indicia 18 on the second face 17 thereof, or for other reasons. For example perforation lines 34, 36 may be provided which are parallel to the edges 20, 21 and allow ready separation of different recorded information once the business form 10 has reached the end of its useful life and is returned to the issuing organization for recordation of the data entered within indicia 18.

The invention also preferably includes a feature that makes it difficult to photocopy the license 30 when it is part of the business form 10. This is preferably accomplished by providing security indicia shown schematically by reference numeral 35 in FIGS. 1, 2, and 5. The security indicia 35 is light enough (both in color and density) so that it does not interfere with the readability of the underlying license 30 indicia 31, but it makes accurate reproduction of the entire form 10 (and particularly the license 30 when inserted therein) by a photocopier difficult if not impossible. Preferably the security indicia 35 comprises an opaque white ink providing a pseudo water mark. While it may be printed on the outer face 23 of the ply 12, or on the inner face 19 thereof with the adhesive pattern 24, 24' disposed thereover, in order to provide another tamper-evident feature it preferably is printed over the adhesive pattern 24, 24'. In this way once the license 30 is sandwiched between the plies 11, 12 if an attempt is made to separate them, portions of the print of the security indicia 35 will be detached from each other, and if an attempt is made to match them up the fact that they had been originally separated will be apparent—thereby providing another tamper-evident feature.

It will thus be seen that according to the present invention an advantageous business form, particularly for use with hunting and fishing licenses, or other situations in which it is necessary to allow data to be recorded and then recovered despite harsh use of the form. The form 10 according to the invention, with and without the license 30, is easy to understand and use, the license 30 is protected permanently from moisture, chemicals, and wear by the highly so moisture resistant ply 11 and the impervious plastic film 12, a tamper-evident feature or features are provided, the license is difficult to accurately photocopy when part of the form 10, the license print will not fade because of the UV coating 27 on the plastic film 12, and the license indicia 31 as well as data entered within the indicia 18 will be readable after the useful life of the license (e.g. when sent back to the Department of Fisheries or Game of the state issuing it after use for a year).

While the invention has been herein shown and described in what is presently conceived to be the most practical and preferred embodiments thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A business form comprising:

a substantially quadrate first ply of an opaque cellulose based water resistant material having first and second faces, first length and width dimensions, and a first area of said first and second faces;

a substantially quadrate second ply of transparent plastic material having third and fourth faces, second length and width dimensions, and a second area of said third and fourth faces;

a first pattern of permanent adhesive substantially permanently attaching only a first portion of said second ply third face to said first ply first face;

a second pressure sensitive adhesive pattern for connecting a second portion of said second ply third face, distinct from said first portion, to said first ply first face, or for substantially permanently adhering a separate sheet therebetween; and first indicia facilitating entry of recoverable data imaged on said first ply second face.

2. A business form as recited in claim 1 further comprising a separable sheet, distinct from said first and second plies, having second indicia thereon, and having a third area less than either said first or second areas and length and width dimensions such that said separable sheet may be disposed between said second portion of said second ply third face and said first ply first face to be held therebetween by said second adhesive pattern, with said second indicia visible through said second ply; and wherein said second adhesive pattern is aggressive enough to provide a tamper-evident feature by tearing the separable sheet if separated therefrom.

3. A business form as recited in claim 1 wherein said second area is less than said first area, defining an always uncovered portion of said first ply first face; and further comprising third indicia imaged on said uncovered portion.

4. A business form as recited in claim 2 wherein said second adhesive pattern is disposed on said second portion of said second ply third face.

5. A business form as recited in claim 4 further comprising security indicia applied over said second adhesive pattern on said second portion of said second ply third face, said security indicia making accurate reproduction of said form by a photocopier difficult.

6. A business form as recited in claim 1 further comprising security indicia applied to said second ply, said security indicia making accurate reproduction of said form by a photocopier difficult.

7. A business form as recited in claim 6 wherein said security indicia is an opaque white ink providing a pseudo watermark.

8. A business form as recited in claim 1 wherein said second ply is polyester or polyethylene film having a UV coating.

9. A business form as recited in claim 1 wherein said first indicia comprises indicia facilitating entry of fish caught or game shot or both.

10. A business form as recited in claim 9 further comprising a separable sheet, distinct from said first and second plies, having second indicia thereon, and having a third area less than either said first or second areas and length and width dimensions such that said separable sheet may be disposed between said second portion of said second ply third face and said first ply first face to be held therebetween by said second adhesive pattern, with said second indicia visible through said second ply; and wherein said second indicia comprises fishing and/or hunting license indicia.

11. A business form as recited in claim 1 wherein said first ply comprises a cellulose sheet coated with wet strength additives which confer water dispersion resistance to said cellulose sheet.

12. A business form as recited in claim 4 wherein said second adhesive pattern comprises a plurality of parallel spaced strips of adhesive.

13. A business form as recited in claim 4 wherein said second pattern of adhesive also comprises adhesive disposed on said first ply first face.

14. A business form as recited in claim 12 wherein said second pattern of adhesive also comprises adhesive disposed on said first ply first face also in the form of a plurality of parallel spaced strips of adhesive, the spaced strips of adhesive on said first and third faces interspersed with each other.

15. A business form comprising:

a substantially quadrate first ply of an opaque cellulose based water resistant material having first and second faces, first length and width dimensions, and a first area of said first and second faces;

a substantially quadrate second ply of transparent plastic material having third and fourth faces, second length and width dimensions, and a second area of said third and fourth faces;

a first pattern of permanent adhesive substantially permanently attaching only a first portion of said second ply third face to said first ply first face;

a second pressure sensitive adhesive pattern for connecting a second portion of said second ply third face, distinct from said first portion, to said first ply first face, or for substantially permanently adhering a separate sheet therebetween; and wherein said second ply is polyester or polyethylene film having a UV coating.

16. A business form as recited in claim 15 further comprising security indicia applied to said second ply, said security indicia making accurate reproduction of said form by a photocopier difficult.

17. A business form as recited in claim 15 further comprising a separable sheet, distinct from said first and second plies, having indicia thereon, and having a third area less than either said first or second areas and length and width dimensions such that said separable sheet may be disposed between said second portion of said second ply third face and said first ply first face to be held therebetween by said second adhesive pattern, with said second indicia visible through said second ply; and wherein said indicia comprises fishing and/or hunting license indicia.

18. A business form comprising:

a substantially quadrate first ply of an opaque cellulose based water resistant material having first and second faces, first length and width dimensions, and a first area of said first and second faces;

a substantially quadrate second ply of transparent plastic material having third and fourth faces, second length and width dimensions, and a second area of said third and fourth faces;

a first pattern of permanent adhesive substantially permanently attaching only a first portion of said second ply third face to said first ply first face;

a second pressure sensitive adhesive pattern for connecting a second portion of said second ply third face, distinct from said first portion, to said first ply first face, or for substantially permanently adhering a separate sheet therebetween; and further comprising security indicia applied to said second ply, said security indicia making accurate reproduction of said form by a photocopier difficult.

19. A business form as recited in claim 18 wherein said second adhesive pattern is on said second portion of said second ply third face; and wherein said security indicia is applied over said second adhesive pattern on said second portion of said second ply third face.

20. A business form as recited in claim 19 wherein said security indicia is an opaque white ink providing a pseudo watermark.

* * * * *